US006454994B1

(12) United States Patent
Wang

(10) Patent No.: US 6,454,994 B1
(45) Date of Patent: Sep. 24, 2002

(54) SOLIDS COMPRISING TANTALUM, STRONTIUM AND SILICON

(75) Inventor: Guangxin Wang, Wexford, PA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/649,824

(22) Filed: Aug. 28, 2000

(51) Int. Cl.[7] ..... C22C 27/02
(52) U.S. Cl. ..... 420/427; 148/422
(58) Field of Search ..... 148/522, 538, 148/668, 422, DIG. 158, 512; 420/427

(56) References Cited

U.S. PATENT DOCUMENTS 3,542,541 A * 11/1970 Lemkey ..... 148/401
3,786,323 A 1/1974 Peters et al.
5,409,517 A * 4/1995 Satou et al. ..... 75/228
5,411,611 A * 5/1995 Kumar et al. ..... 148/557
5,614,437 A 3/1997 Choudhury

OTHER PUBLICATIONS

"The Effect of Ta to Si Ralio on Magnerron Sputtered Ta–Si–N Thin Films"; J.O. Olowolafe et al; Journal of Electronic Materials, vol. 28, No. 12, 1989; pp. 1399–1402.

* cited by examiner

*Primary Examiner*—John Sheehan
*Assistant Examiner*—Andrew L. Oltmans
(74) *Attorney, Agent, or Firm*—Wells St. John P.S.

(57) ABSTRACT

The invention includes a method of forming a solid from at least two different powdered materials. A first and second of the different powder materials is compressed into a pellet. A melt pool is formed at a temperature which will melt both the first and second materials. The pellet is fed to the melt pool to melt the first and second materials, and the melted first and second materials are subsequently cooled to form the solid. The invention also includes a method of forming a solid which includes tantalum and silicon. The invention further includes a homogeneous solid comprising tantalum and silicon, and formed from a molten mixture of tantalum and silicon.

8 Claims, 1 Drawing Sheet

SOLIDS COMPRISING TANTALUM, STRONTIUM AND SILICON

TECHNICAL FIELD

The invention pertains to methods of forming solids, and in particular applications pertains to methods of forming solids comprising tantalum and silicon. The invention also pertains to solids which comprise tantalum and silicon, and in particular applications pertains to sputtering targets and methods of forming sputtering targets.

BACKGROUND OF THE INVENTION

An on-going trend in semiconductor processing is to incorporate copper into semiconductor devices. Copper can have advantages relative to other materials in that copper is exceptionally conductive. However, a difficulty in utilizing copper is that copper atoms can diffuse through a number of commonly-utilized materials. If copper atoms diffuse into materials that are intended to be insulative, the copper atoms can render an integrated circuit device unusable. Accordingly, there has been an effort to develop barrier layers which can prevent copper diffusion. Barrier layer materials which have received particular interest are materials comprising tantalum and silicon. Such materials can comprise a homogeneous mixture of tantalum and silicon, and can further comprise one or both of nitrogen and oxygen.

Materials comprising tantalum and silicon can be sputter-deposited from targets comprising the tantalum and silicon in a desired stoichiometric ratio. Typically, the targets will comprise at least about 70% tantalum, and the remainder will be either silicon, or a mixture of silicon with one or more other elements. If the sputter-deposition occurs in an atmosphere which is inert relative to reaction with the materials of the target (such as, for example, an argon atmosphere), a film having a composition approximately identical to that of the target will be sputter-deposited from the target. If the target is instead exposed to an atmosphere reactive with one or more materials of the target (such as, for example, an atmosphere comprising one or both of nitrogen and oxygen), a film can be deposited which has components from the atmosphere in addition to the components from the target material. For instance, if a target consisting essentially of tantalum and silicon is sputter-deposited in a nitrogen atmosphere, a film comprising tantalum, silicon and nitrogen can be formed. Further, if a film comprising tantalum and silicon is sputter-deposited in an atmosphere comprising oxygen, a film comprising tantalum, silicon and oxygen can be formed. Suitable sources of nitrogen can include, for example, $N_2$; and suitable sources of oxygen can include, for example, $O_2$.

Ideally, a sputtering target comprising tantalum and silicon will have a homogeneous mixture of tantalum and silicon throughout its construction so that homogeneous films will be formed from the target. However, it is found to be difficult to form targets having homogeneous distributions of tantalum and silicon. Specifically, a traditional method for forming a homogeneous mixture of solid materials would be to melt the materials together, and then solidify the melt into a solid comprising a homogeneous distribution of the materials. However, traditional technologies do not work with tantalum and silicon, and to date there has been no process developed which can form a homogeneous mixture of tantalum and silicon from a melt. Instead, the present technologies for attempting to form homogeneous solid mixtures of tantalum and silicon are to mix tantalum and silicon powders together, and thereafter subject the powders to compressive forces which mold the powders into a solid form. While such technologies can form solids which approach a homogeneous distribution of silicon and tantalum materials, there can be pockets within the materials wherein the tantalum and silicon powders were not uniformly distributed, and accordingly wherein the composition of the solid is not homogeneous relative to other portions of the solid. Accordingly, it would be desirable to develop new technologies for forming homogeneous mixtures of tantalum and silicon.

SUMMARY OF THE INVENTION

Although a motivation for the present invention was to develop a better process for forming homogeneous solid mixtures comprising tantalum and silicon, the invention is not limited to processes comprising tantalum and silicon. Accordingly, in one aspect the invention encompasses a method of forming a solid from at least two different powdered materials. A first and second of the different powder materials is compressed into a pellet. A melt pool is formed at a temperature which will melt both the first and second materials. The pellet is fed to the melt pool and the first and second materials are melted. The melted first and second materials are subsequently cooled to form the solid.

In another aspect, the invention encompasses a method of forming a solid which includes tantalum and silicon.

In yet another aspect, the invention encompasses a homogeneous solid comprising tantalum and silicon, and formed from a molten mixture of tantalum and silicon. For purposes of interpreting this disclosure and the claims that follow, a "homogenous solid comprising tantalum and silicon" refers to a solid in which the relative concentration of tantalum to silicon is constant throughout the composition of the solid.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
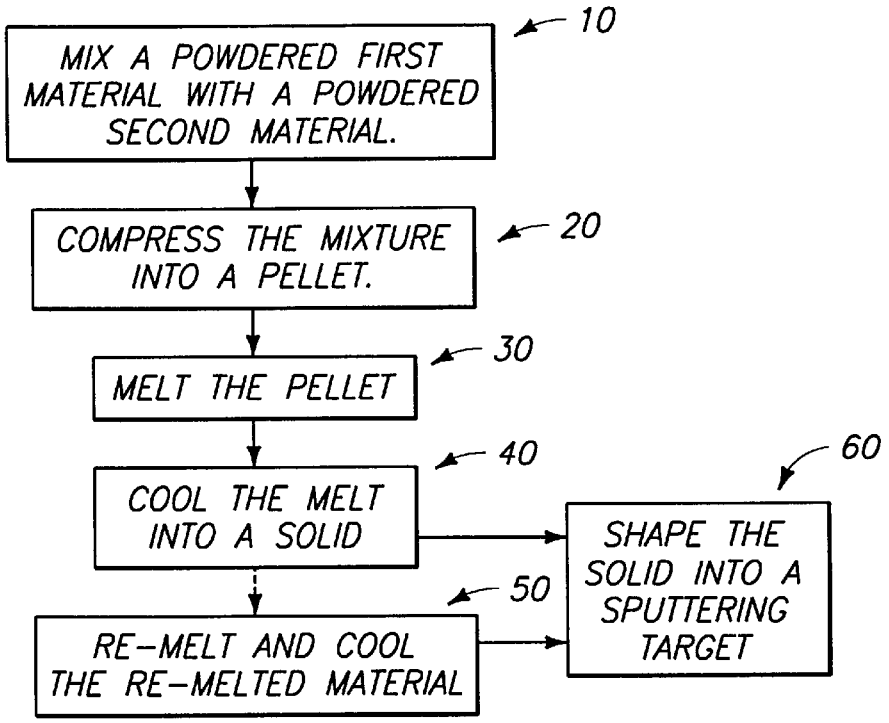
FIG. 1 is a flow-chart diagram of methodology of the present invention.

One aspect of the present invention is a recognition that the difficulty associated with forming a homogeneous melt of tantalum and silicon may be due at least in part to the large difference in density of tantalum relative to silicon. Specifically, tantalum has a density of 16 grams per cubic centimeter (16 $g/cm^3$), while silicon has a density of 2.34 $g/cm^3$. Accordingly, the tantalum will tend to settle and the silicon rise from a melt comprising both tantalum and silicon. Also, the density difference between silicon and tantalum can make it difficult to homogeneously mix tantalum powders with silicon powders. The problems associated with density differences of silicon and tantalum can make it difficult to form a homogeneous melt comprising tantalum and silicon, and such renders it difficult to form a homogeneous solid from molten tantalum and silicon. The difficulties associated with forming a melt of tantalum and silicon can be further compounded by the difference in melting temperature of tantalum and silicon, with tantalum having a melting temperature of about 2996° C., and silicon having a melting temperature of about 1414° C. If silicon is exposed to the high melting temperature of tantalum, a significant amount of the silicon can vaporize.

The invention encompasses a further recognition that when two materials have substantially different densities and/or melting temperatures, one method of forming a homogeneous melt from the materials is to first compress powders of the materials into a substantially homogeneous solid, and to then rapidly melt and re-cool the powdered mixture to form a cast solid material.

An exemplary method of the present invention is described with reference to the flow chart of FIG. 1. At initial step 10 of the FIG. 1 flow chart, a powdered first material is mixed with a powdered second material. In an exemplary process wherein tantalum and silicon are to be combined, the powdered first material can comprise tantalum and the powdered second material can comprise silicon. In particular embodiments, the powdered first material can consist essentially of, or consist of tantalum, and the powdered second material can consist essentially of, or consist of silicon. Also, additional powdered materials can be provided into the mixture of tantalum and silicon. Such powdered materials can include, for example, one or more of strontium, zirconium and titanium. In particular embodiments, the powders will comprise particle sizes of from about 50 microns to about 200 microns, and the various materials in the powders will be at least 99.5% pure. Accordingly, the tantalum powder will comprise at least 99.95 atom % tantalum, and the silicon powder will comprise at least 99.95 atom % silicon.

An exemplary mixture which can be utilized for forming a solid comprising tantalum and silicon is a mixture comprising at least about 70 weight % tantalum powder, and from greater than 0 weight % silicon powder to about 30 weight % silicon powder (the range of silicon concentration can be, for example, from 5 weight % to 25 weight %). Also, the mixture can comprise up to about 20% of one or more powders comprising, consisting of, or consisting essentially of one or more of strontium, zirconium, yttrium and titanium. In other embodiments, the mixture can comprise at least about 50% of the tantalum powder, with the remainder being silicon powder and one or more powders comprising one or more of strontium, zirconium, yttrium and titanium.

The powders of step 10 are preferably mixed until a substantially homogeneous composition is obtained, with the term "substantially homogeneous" referring to a mixture which appears homogeneous upon visual inspection.

At step 20 of the FIG. 1 flow chart, the mixture is compressed into a pellet. Preferably, the mixture will be compressed to a compression ratio of 40% or higher relative to a theoretical density of the material, and more preferably will be compressed to a compression ratio of at least 50% relative to the theoretical density. The theoretical density will vary depending upon the materials utilized in the mixture and the relative amounts of the materials, and can be calculated utilizing conventional methods.

The compression of the mixture can comprise either a cold-pressing method (i.e., a method occurring at or below about room temperature), or a hot pressing method. Depending on the amount of compression, the compressed powders may heat to a temperature substantially greater than room temperature due to energy generated by the compression of the materials.

Referring to step 30 of the FIG. 1 flow chart, the pellet of step 20 is melted. Preferably, the pellet is exposed to a temperature higher than that required to melt all of the components of the mixture. Generally, this will comprise exposing the mixture to a temperature higher than the highest melting temperature of any component of the mixture. For instance, if tantalum is the component of the mixture with the highest melting temperature, then the mixture would preferably be exposed to a temperature in excess of the 2996° C. melting temperature of tantalum.

In preferred applications, the temperature is at least 10% higher than the melting temperature of the highest melting temperature component, and can be, for example, 50% higher or two-fold higher. For instance, if tantalum is the highest melting temperature component, then the mixture will preferably be exposed to a temperature of at least 3300° C., and can be 6000° C. A temperature of 3300° C. or higher will insure melting of all of the components of the mixture.

In a particular application, a mixture comprising tantalum and silicon, and having tantalum as the highest melting temperature component, is exposed to a plasma torch comprising a flame temperature which can be as high as 8000° C. A suitable plasma can be formed from an arc of high temperature electromagnetic wave energy comprising ionized gas molecules, such as, for example, ionized argon gas molecules. The plasma can be generated and maintained in a chamber in which a pressure is controlled. It can be preferred to have a pellet exposed to pressures in excess of atmospheric pressure during melting of the pellet to inhibit vaporization of the various components of the pellet. When mixtures of tantalum and silicon are melted, both high temperature and overpressure melting can be preferred, in light of the high melting point of tantalum and the large difference in melting temperatures of tantalum and silicon.

The melting of the pelletized mixture can occur in a chamber, with a gas flowing through the chamber. It can be preferred that the only gases flowing through the chamber are gasses which are inert relative to reaction with the pelletized materials, and also inert relative to reaction with any melt formed from the pelletized materials. A suitable gas can be, for example, argon. In particular applications, a gas consisting of argon will be the only gas flowing through the chamber. A pressure of argon within the chamber can be maintained above the partial pressure of silicon at temperatures of the melt, with an exemplary pressure being 795 mmHg. The argon at such pressure can avoid any significant vapor losses of silicon during melting of tantalum. Accordingly, the methodology of the present invention can retain the stoichiometry of tantalum and silicon in a pellet within a melt formed from the pellet. If other materials are incorporated into the mixture of tantalum and silicon, the invention can also retain the stoichiometry of such elements within a melt formed from a pellet. For instance, if relatively low-melting materials such as, for example, titanium, strontium, yttrium and zirconium are included in the pellet, the argon pressure can avoid vapor losses of such materials, and accordingly can retain a stoichiometry of such materials in a melt formed from a pellet comprising the materials.

Methods by which a pellet from step 20 can be melted in step 30 include (1) passing the pellet through a high temperature plasma torch so that molten material falls from the torch into a melt solution; and (2) placing a pelletized material directly into a melt that is at a temperature higher than the melting temperature of the highest melting component of the material, and thereby melt the material directly within the already existing molten solution. Alternatively, the methodology of the present invention can comprise a combination of the two methods. Specifically, a pellet can be passed through a plasma torch to melt at least some of the pellet, and the remainder of the pellet can fall into a melt solution wherein it is melted.

Figure 2:
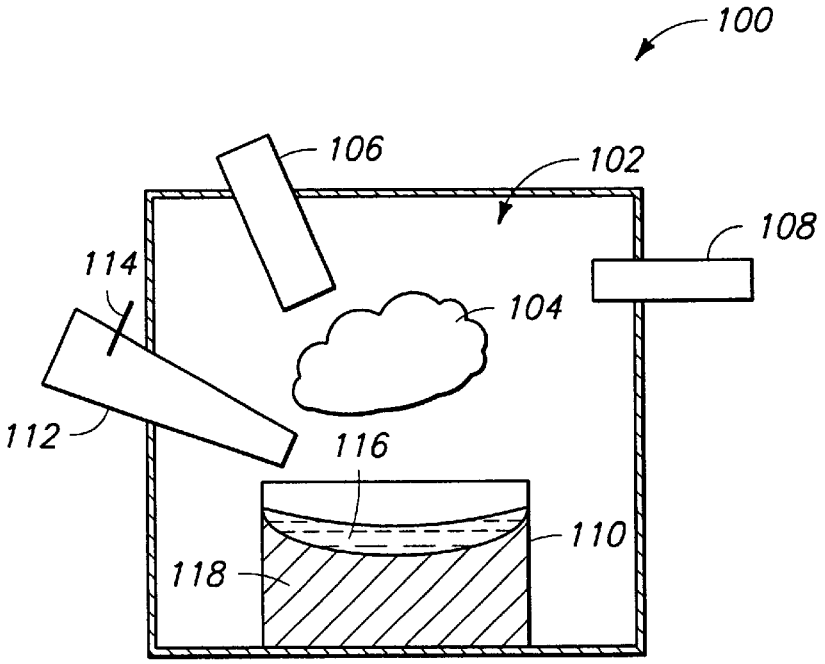
FIG. 2 is a diagrammatic view of an apparatus which can be utilized in methodology of the present invention.

An apparatus which can be utilized in methodology of the present invention for forming a melt is described with reference to FIG. 2, and is shown as an Apparatus 100. Apparatus 100 comprises a gas-tight chamber 102, within which a plasma 104 is maintained. A suitable gas, such as, for example, argon, is fed through a tube 106 and into the plasma to maintain the plasma. Also, suitable power, such as, for example, direct current power can be passed into chamber 102 for maintaining the plasma. An outlet 108 is provided so that gas can flow continuously through the chamber.

A typical plasma torch consists of elongated tube 106 with an electrode co-axially within the tube. A working gas, which can be any gas or gas mixture, including air, is passed through the tube. In particular embodiments, argon can be used as the working gas to prevent oxidation and/or nitration of metals. A high direct current voltage is applied across the gap between the end of the center electrode that acts as an anode and an external electrode acting as a cathode. The external electrode can be, for example, metal from a piece that is to be melted, or metal from a mold 110. The current flowing through the gas in the gap causes the formation of an arc of high temperature eletromagnetic wave energy comprised of ionized gas molecules. The temperature at the plasma arc centerline can be as high as 50,000° C. Commercially available plasma torches can develop a furnace or work piece temperature as high as 8,000° C. for sustained periods. They are available in sizes from about 100 kW to over 6 mW in output power. The extremely high temperature generated by a plasma can melt a high melting point metal such as tantalum.

Mold 110 is provided at a bottom of the chamber, and is shaped to form an ingot from molten material. Mold 110 can be water-cooled. An electromagnetic casting technique can be used to shape a solidifying material instead of mold 110. The electromagnetic casting technique uses electromagnetic forces to replace a mechanical mold, and specifically a metal melt is supported in air by a well-shaped Lorenz force while being solidified. The electromagnetic casting technique can eliminate contact of the melt with mold materials, and can thus enable high-purity ingots to be obtained with improved surface smoothness. The electromagnetic casting technique may also enable a higher ingot yield than mechanical mold techniques.

A feed tube 112 is provided at a side of the chamber, and a valve 114 is provided so that a feed rate can be regulated through tube 112. Tube 112 is preferably constructed so that the pellets of step 20 of FIG. 1 can be fed through the tube. The pellets of step 20 can be any desired size, and preferably the size will be such that the pellets feed readily through tube 112. The pellets exit tube 112 and either pass through plasma 104, or beneath plasma 104, and into a molten pool 116. The pool is maintained as a molten pool by energy from plasma 104. The molten material within pool 116 cools at a lower surface of the pool to form a solid material 118. Pool 116 moves upwardly within mold 110 as the solidified material 118 forms beneath pool 116. An energy imparted by a plasma torch can be varied as pool 116 moves upwardly toward plasma 104. Specifically, the torch can be provided to be initially hotter as pool 116 is far beneath the plasma, and then can progressively become cooler as melt 116 moves upwardly toward the plasma. Alternatively, the solidified material in mold 110 can be moved downwardly to keep pool 116 at a substantially constant level relative to plasma 104.

In the shown embodiment, tube 112 is provided so that pellets will fall beneath a shown plasma 104 and into melt 116. It is to be understood, however, that plasma 104 can extend across an outlet of tube 112 so that pellets pass through the plasma and are melted by the plasma prior to entering melt solution 116, or that alternatively the pellets can pass beneath the plasma and enter solution 116 as solid material, which is then melted to maintain melt solution 116.

Referring to step 40 of FIG. 1, the molten material from step 30 is cooled into a solid. The material can then be shaped into a sputtering target as shown at step 60. Prior to, or during such shaping, the material can be subjected to forging, hot rolling, or other metal-working technologies to alter a grain size and/or crystallographic orientation within the material. Although "metal-working" can be utilized for processing materials formed in accordance with the present invention, it is to be understood that materials formed by methodology of the present invention can be other than metals, such as, for example, ceramics.

In embodiments in which an ingot comprising tantalum and silicon is formed, the metal-working can be done "cold" (i.e., at or below room temperature) if the concentration of silicon is low. Pure tantalum generally exhibits a very good room temperature ductility, and a large amount of cold work can thus be done before annealing pure Ta target blanks to achieve grain refinement. Fine grain sizes can be desired in particular applications. For instance, fine grain sizes are generally desirable in sputtering targets for achieving good sputtering performance from the targets. With increasing Si content, the ductility of a Ta—Si alloy decreases. The reason for this is believed to be that there is an increasing formation of brittle inter-metallics of $Ta_5Si$, $Ta_2Si$, $Ta_5Si_3$, and $TaSi_2$ with increasing silicon content. To prevent cracking, Ta—Si ingots containing these inter-metallics can be warm or hot processed, meaning that deformation is conducted at elevated temperatures. Because both Ta and Si are easily oxidized, special coating techniques and vacuum or inert gas heat treatment techniques are preferably utilized during thermo-mechanical processing of Ta—Si ingots. Heat treatment of Ta—Si materials produced in accordance with the present invention can be conducted before, during or after metal-working to improve a uniformity of distribution of elements within the materials, to alter grain size, and/or to adjust crystallographic orientation within the materials. The heat treatment can be conducted at a temperature of, for example, from about 800° C. to about 1400° C. Since Ta and Si can readily oxidize, it can be preferred to conduct any heat treatment under conditions which protect Ta and Si from oxidizing, such as, for example, to keep the Ta—Si materials under an inert atmosphere (such as argon), under vacuum, or under a protective coating (such as glass) during the heat treatment.

Step 50 of FIG. 1 shows an optional process whereby a material from step 40 can be subjected to further melting and re-cooling to increase homogeneity within the solid material. Such melting and re-cooling will preferably occur at temperatures in excess of the highest melting point temperature of any component within the material. An additional benefit of the re-melting and re-cooling can be to purify metals by volatilizing certain impurities (such as, for example, carbon).

It can be desired that a material cool at a rate during the processing of step 40 and/or the processing of step 50 which maintains even distribution of the various components of the material. Specifically, if the material is left in a molten form for too long, the various components of the material can separate (i.e., micro-segregation can occur). Alternatively, if the material is cooled too rapidly, the various components of the material will not have sufficient time to mix with one another and the material will have a composition that reflects inhomogeneities that may have been present in the starting powder. Also, agitation during melting can aid in achieving a homogeneous product. Such agitation can be supplied from different sources including arc pressure, mechanical oscillation of solidified metal and metal melt, thermal convection within the molten metal pool, and external electromagnetic stirring.

Although the invention is described with reference to tantalum and silicon, it is to be understood that the invention can have application to numerous technologies wherein it is desired to form a homogeneous mixture of materials that differ significantly in one or both of density and melting point. For instance, the invention can be utilized to form homogeneous mixtures or materials that differ in density by at least 20%, such as, for example, materials that differ in density by two-fold, three-fold, four-fold, five-fold, six-fold or greater. For instance, the tantalum and silicon of the above-described embodiment differ in density by more than six-fold. Also, the invention can be utilized to create homogeneous mixtures from materials that differ in melting point by 1.5-fold, two-fold or greater. For instance, the tantalum and silicon of the above-described embodiment differ in melting point by more than two-fold.

If the invention is utilized for forming a sputtering target comprising tantalum and silicon, such target can be used to sputter-deposit a film comprising the tantalum and silicon. If the sputter-deposition occurs in an atmosphere which is inert relative to reaction with the materials of the target, the film deposited from the target can have a composition that reflects the stoichiometry initially present in the target. For instance, if the target comprises tantalum and silicon, then the film can also comprise tantalum and silicon. Also, if the target consists of tantalum and silicon, the film can consist of tantalum and silicon. Alternatively, if the target consists of tantalum and silicon and one or more of zirconium, titanium, strontium or yttrium; the film can also consist of tantalum, silicon, and the one or more of titanium, strontium, yttrium, or zirconium.

In other exemplary processing, the target can be exposed to an atmosphere which comprises one or more components which will react with one or more materials of the target to form a film having a different composition than the target. For instance, the target can be sputter-deposited in an atmosphere comprising one or both of nitrogen and oxygen to form a film which includes the one or both of nitrogen and oxygen. Particular films that can be deposited utilizing methodology of the present invention are $Ta_5Si$, $Ta_2Si$, $Ta_5Si_3$, $TaSi_2$, $Ta_{0.24}Si_{0.10}N_{0.66}$, and $Ta_{0.24}Si_{0.12}N_{0.64}$.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A homogenous solid consisting of tantalum, silicon and strontium.

2. The homogeneous solid of claim 1 the form of a sputtering target.

3. The homogeneous solid of claim 1 wherein the concentration of strontium is less than about 20 weight %.

4. The homogeneous solid of claim 1 wherein the concentration of tantalum is greater than about 50 weight %.

5. The homogeneous solid of claim 1 wherein the concentration of tantalum is greater than about 70 weight %.

6. The homogeneous solid of claim 1 wherein the concentration of silicon is less than about 30 weight %.

7. The homogeneous solid of claim 1 wherein the concentration of silicon is from about 5 weight % to about 25 weight %.

8. The homogeneous solid of claim 1 formed from a molten mixture of tantalum, silicon and strontium.

* * * * *

UNITED STATES PATENT AND TRADEMARK OFFICE

CERTIFICATE OF CORRECTION

PATENT NO. : 6,454,994 B1 
DATED : September 24, 2002
INVENTOR(S) : Guangxin Wang It is certified that error appears in the above-identified patent and that said Letters Patent is hereby corrected as shown below:

Title page,
Item [56], References Cited, OTHER PUBLICATIONS, please replace "Si Ralio on Magnerron" with -- Si Ratio on Magnetron --

Column 8,
Line 24, please replace "claim 1 the form" with -- claim 1 in the form --

Signed and Sealed this

Twenty-fifth Day of March, 2003

JAMES E. ROGAN
*Director of the United States Patent and Trademark Office*